US006318142B1

(12) United States Patent
Wood

(10) Patent No.: US 6,318,142 B1
(45) Date of Patent: Nov. 20, 2001

(54) SPACER DEVICE FOR A BASKET FORMING APPARATUS

(75) Inventor: Ian Wood, 177 Woodhall Way, Beverley, East Yorkshire, HU17 7JU (GB)

(73) Assignees: Ian Wood; Barry Wood, both of East Yorkshire (GB)

( * ) Notice: Subject to any disclaimer, the term of this patent is extended or adjusted under 35 U.S.C. 154(b) by 0 days.

(21) Appl. No.: 09/544,018

(22) Filed: Apr. 6, 2000

(30) Foreign Application Priority Data

Apr. 9, 1999 (GB) ..... 9907970

(51) Int. Cl.[7] ..... B21D 11/14
(52) U.S. Cl. ..... 72/299; 72/371; 269/37
(58) Field of Search ..... 72/302, 371, 462, 72/466.2, 483, 295, 305, 293, 299; 269/37

(56) References Cited

U.S. PATENT DOCUMENTS 2,855,972 * 10/1958 Greider ..... 72/295
4,007,616 * 2/1977 Aleck ..... 72/302
4,262,515 * 4/1981 Frei ..... 72/302
4,549,423 * 10/1985 Masui ..... 72/295
5,801,336 * 9/1998 Blanding ..... 174/146

FOREIGN PATENT DOCUMENTS 197 15 081 A1 1/1998 (DE) .
3221736 * 12/1983 (DE) ..... 72/371
WO 97/18908 5/1997 (WO) .

* cited by examiner

*Primary Examiner*—Daniel C. Crane
(74) *Attorney, Agent, or Firm*—Fay, Sharpe, Fagan, Minnich & McKee, LLP

(57) ABSTRACT

A spacer device for use with a basket forming apparatus, the spacer device comprises a plurality of angularly spaced, radially extending arms (3, 4, 5, 6) corresponding in number to the number of metal bars forming the basket, each of which arms is adapted in use to engage with a respective one of the metal bars forming the basket-shaped article as the said article is twisted into its finished shape.

10 Claims, 4 Drawing Sheets

SPACER DEVICE FOR A BASKET FORMING APPARATUS

The present invention relates to a spacer device for use with apparatus for forming from a plurality of metal bars secured together at each end a twisted and enlarged basket of bulbous shape, as illustrated in FIG. 1 of the accompanying drawings. These basket-shaped articles are commonly used as decorative features in wrought iron designs.

It is known to form decorative baskets from a plurality of metal bars using both manually operated and electro-hydraulic machines. A manually operated apparatus for forming baskets from metal bars is disclosed in PCT/GB96/02817. In general terms the operating procedure for both machines is the same. Firstly, a group of straight, square section metal bars, typically four in number, with the ends secured together is secured at each end between a fixed gripper ring or clamp and a rotatable gripper ring or clamp of the machine. The bars are then twisted on the machine through 360 degrees in one direction causing the bars to assume the shape and configuration shown in FIG. 2 of the accompanying drawings. The bars are then twisted in the reverse direction through 720 degrees whilst at the same time the distance between the fixed and the rotatable clamps is shortened to exert a compressive force on the bars. This is illustrated in FIG. 3 of the accompanying drawings. The result is generally that each steel bar in the now formed basket has, by virtue of its initial twist, lost its ability to resist a compressive force and so when twisted in the reverse direction and compressed buckles outwardly to assume the required bulbous shape. Each of the bars in the group is subject to near destructive twisting, particularly in the regions (a) thereof where the bars enter the clamps. In metallurgical terms this weakens the bars at these points.

For ease of availability and for cost considerations general quality hot rolled mild steel is the material of choice for the metal bars from which decorative baskets are formed. However, the manufacturing tolerances of this material are so wide that even along a single length of 6 meter stock bar its size, cross-section and strength can vary greatly. These variations can give rise to inconsistencies in the shape of the formed baskets. In particular, the size of the gap between each adjacent pairs of bars can be irregular. This problem can be overcome by using metal bar of high quality and close dimensional tolerances. However, the cost of such bar makes the finished product prohibitively expensive.

It is an object of the present invention to provide a spacer device for use with a basket forming apparatus which ensures regular spacing between the metal bars forming the basket, thus obviating the need to employ quality close tolerance steel.

According to the present invention there is provided a spacer device for use with a basket forming apparatus, the spacer device comprising a plurality of angularly spaced, radially extending arms corresponding in number to the number of metal bars forming the basket, each of which arms is adapted in use to engage with a respective one of the metal bars forming the basket-shaped article as the said article is twisted into its finished shape.

In use the spacer device according to the present invention is placed in position on the unfinished basket-shaped article immediately prior to untwisting the article through the last few degrees of rotation. As the article is twisted through these last few degrees of rotation each of the metal bars engages with a respective one of the arms of the spacer device, thus ensuring that the gap between adjacent pairs of metal bars is limited to the angular distance between the arms against which they engage.

In a preferred embodiment of the present invention the bars forming the spacer device are equi-angularly spaced, thus ensuring that all of the metal bars forming the basket-shaped article are equi-distantly spaced.

To ensure that the spacer device is retained in position on the unfinished basket-shaped article at least one of the said radially extending arms may comprise a hook at its free end which hooks over one of the metal bars forming the basket-shaped article.

In one embodiment of the present invention each of the said arms extends radially outwardly from a central hub.

In an alternative embodiment of the present invention each of the said arms extends radially inwardly from an annular support or collar the internal diameter of which is greater than the maximum outer diameter of the basket-shaped article. In this alternative embodiment each of the said arms is at least partially retractable relative to the collar thereby facilitating placement of the spacer device on the article and engagement of the arms in the gaps between adjacent pairs of metal bars. The arms can also be retracted to facilitate removal of the spacer device from the finished article.

The retractable arms may be moved in and out of their working positions simultaneously by means of an automatic drive system. Alternatively, each arm may be moved manually between its extended and retracted positions. In this later case each arm is preferably connected to a spring which biases it towards its extended position and locking means for engaging the arm against the spring bias in its retracted position.

Embodiments of the present invention will now be described, by way of example, with reference to the accompanying drawings, in which.

Figure 1:
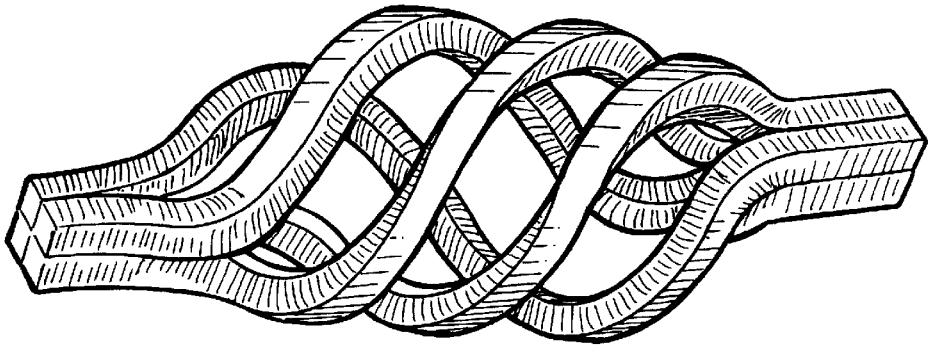
FIG. 1 shows a typical basket-shaped article formed from a cluster of four metal bars.
Figure 2:
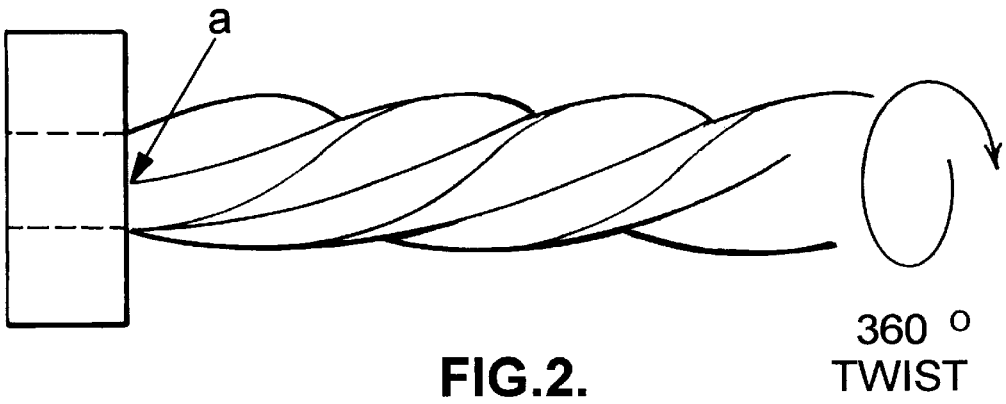
FIG. 2 shows the first stage in the manufacture of the basket-shaped article shown in FIG. 1.
Figure 3:
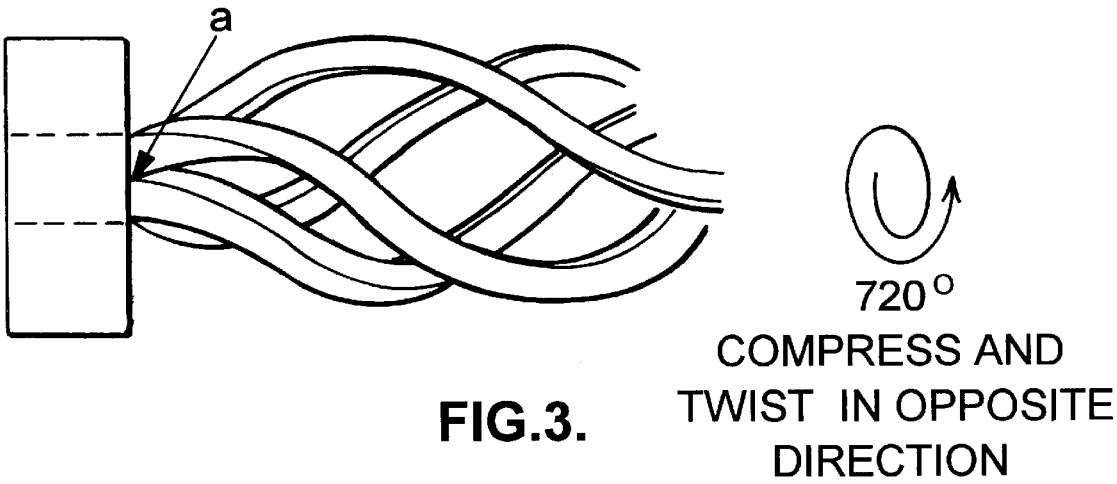
FIG. 3 shows the second stage in the manufacture of the basket-shaped article shown in FIG. 1.
Figure 4:
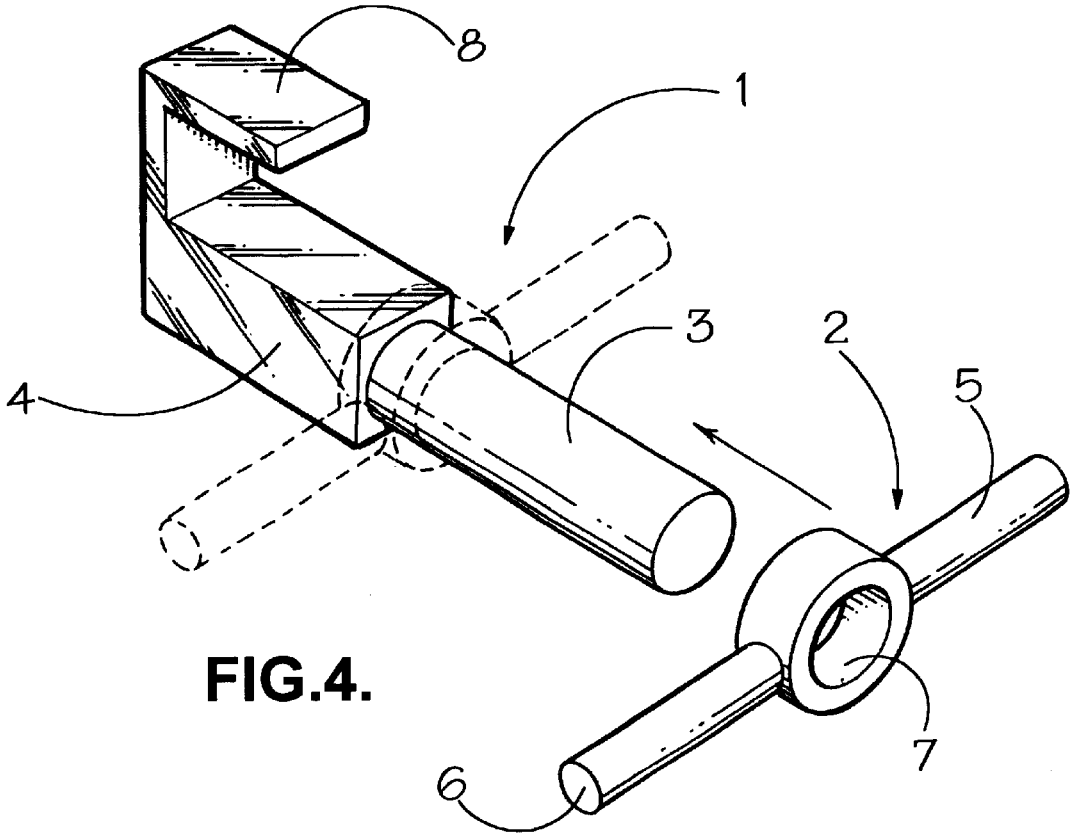
FIG. 4 shows one embodiment of a spacer device according to the present invention for use in the manufacture of basket-shaped article formed from four metal bars.
Figure 5:
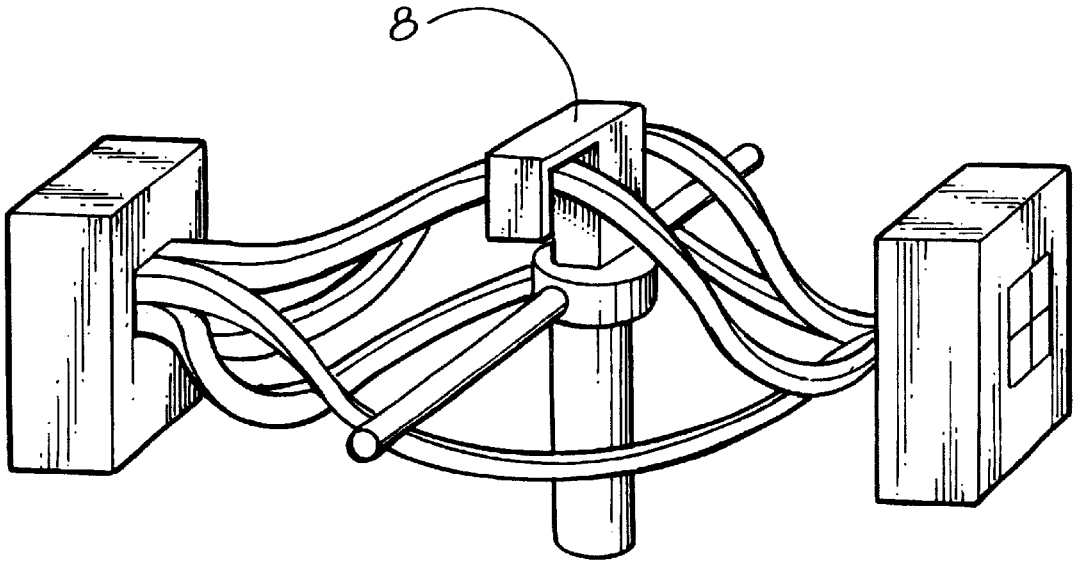
FIG. 5 shows the spacer device of FIG. 4 mounted in position between the bars of a basket-shaped article which is in the second stage of manufacture.

Referring to FIG. 4 of the accompanying drawings there is shown an embodiment of a spacer device in accordance with the present invention for use with the most common of basket designs where four square bars are welded together and subjected to the predetermined twisting and compressing actions as described earlier. The spacer device is comprised of two parts 1 and 2 which are adapted to be connected together to form a cross of four radially extending arms 3 to 6, equidistantly spaced from each other by 90 degrees. The two parts 1 and 2 are simply connected together by inserting arm 3 of part 1 into a through hole in the central body 7 of part 2. A hook 8 is provided at the free end of arm 4 to enable the spacer device to be secured in position to one of the metal bars forming a basket-shaped article as can be seen in FIG. 5.

The spacer device fits easily into the inner void of the basket-shaped article just before its formation is complete at a state of the untwisting where the gap between each adjacent pair of metal bars is greater than the diameter of the arms 3 to 6 forming the spacer device. At this stage of introducing the spacer device into the basket it must be appreciated that the metal bars that constitute the structure of the basket-shaped article have undergone considerable torsional disruption such that they each, for the reasons mentioned hereinabove, responded slightly differently to each other in the total process and this usually results in the gaps varying.

Having introduced the spacer device into the inner void of the basket-shaped article and hooked the hook 8 over one of the metal bars thereof the final few degrees of rotation can now be executed. As it is each metal bar forming the article engages against a respective one of the arms 3, 5 and 6, with the fourth metal bar being engaged by the hook 8 on the end of arm 4. This ensures that the gap between each adjacent pair of metal bars is equal to the angular distance between each adjacent pair of arms 3 to 6. Once satisfied with the result, the spacer device can be easily removed from the inner void of the basket-shaped article by withdrawing part 1 from part 2.

It will be appreciated that the spacer device can be used on basket-shaped articles during their manufacture. It can also be used to rectify basket-shaped articles which have been malformed in previous operations, thus avoiding the need to scrap them. This is simply done by placing the basket back into the twisting machine and slightly untwisting it to a point where the gaps between all bars are just wide enough to accept the arms. After introducing the spacer device into the basket void, the basket-shaped article can be finally twisted through a few degrees to the point where all metal bars touch the spacer arms thus producing a perfect shape.

The design of the spacer device is such that upon completion of the basket-shaped article the spacer arms can be easily removed without causing any disruption to it.

Where it is required to produce a basket-shaped article comprising eight metal bars instead of four, two of the spacer devices shown in FIG. 4 may be used together with one of the two offset from the other by an angle of 45 degrees.

Figure 6:
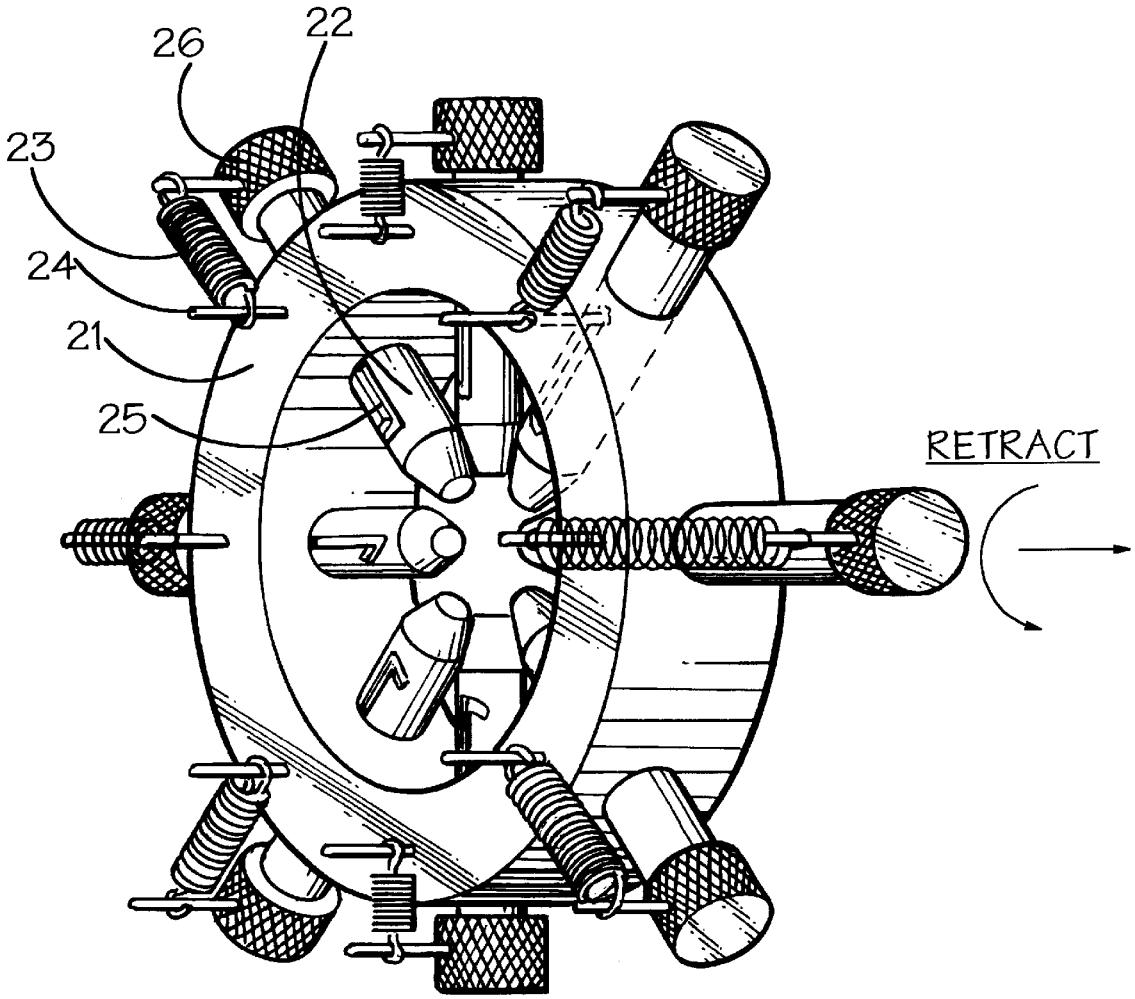
FIG. 6 shows a second embodiment of a spacer device according to the present invention for use in the manufacture of basket-shaped articles formed from eight metal bars.
Figure 7:
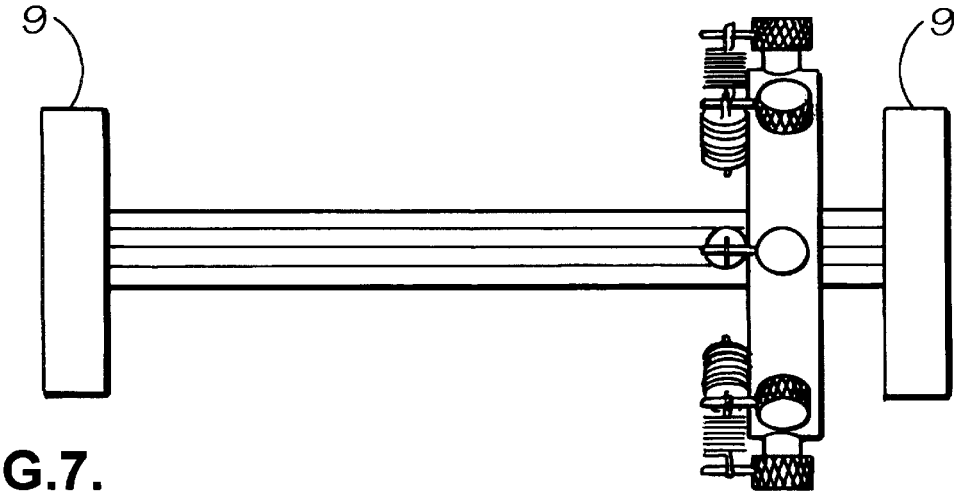
FIGS. 7, 8 and 9 illustrate how the spacer device shown in FIG. 6 is employed during the manufacture of a basket-shaped article.
Figure 8:
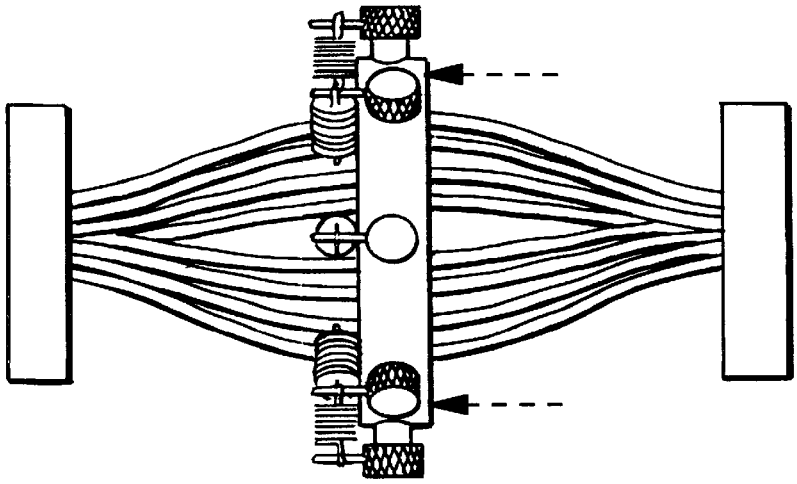
Figure 9:
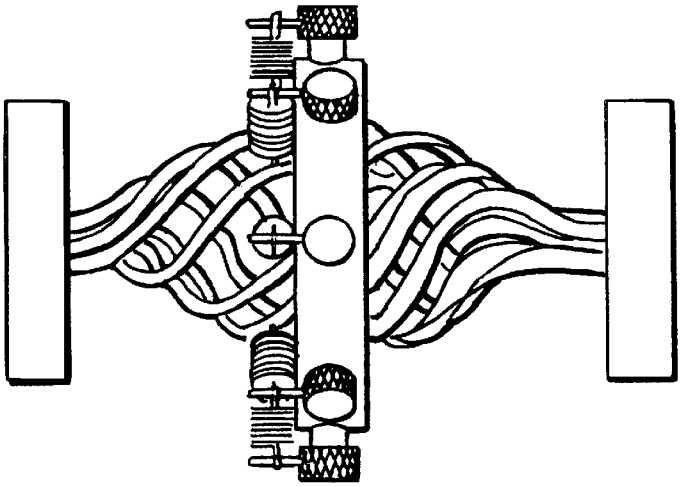

Referring now to FIG. 6 there is shown an alternative embodiment of a spacer device according to the present invention. The spacer device comprises a circular collar 21 which is greater in diameter than the maximum diameter of the basket-shaped article on which it will be used. As shown, eight round equiangularly spaced arms 22 are supported in guide holes in the collar 21. This eight armed spacer device can be used on basket-shaped articles with either four or eight metal bars. However, if it is only to be used on articles with four metal bars four of the spacer arms 22 can be dispensed with.

Between each arm 22 and the collar 21 is a spring 23 which causes the arm 22 to be biased inwardly towards the center of the collar 21. A guide pin 24 engages through the collar 21 into a slot 25 in each arm 22. Towards the inner end of each arm 22 the slot 25 turns back on itself for a small distance. By retracting an arm 22 back against the spring 23 and then twisting it the guide pin 24 can be engaged in this turned back part of the slot 25 to hold and retain the arm in a retract position against the spring 23. A knob 26 is provided at the outer end of each arm to facilitate pulling it back and twisting it. This enables the spacer device to be positioned for use on a basket-shaped article. It also facilitates removal of the spacer device after use.

In use the spacer device shown in FIG. 6 operates in exactly the same way as the one shown in FIG. 4.

Although the spacer device described with reference to FIG. 6 is manually operated it will be understood that it can be adapted for automatic operation. In particular each of the retractable arms may be connected to drive system which causes them all to be extended and withdrawn relative to the collar simultaneously.

What is claimed is:

1. A spacer device for use with a basket forming apparatus which comprises a twisting machine for twisting a number of metal bars into a basket-shaped article, the spacer device comprising a plurality of angularly spaced, radially extending arms (3, 4, 5, 6) corresponding in number to the number of metal bars forming the basket and fixed in a select angular relationship with respect to each other, each of which arms is adapted in use to engage with a respective one of the metal bars forming the basket-shaped article as said article is twisted into its finished shape within the basket forming apparatus.

2. A spacer device according to claim 1, wherein the bars forming the spacer device are equi-angularly spaced.

3. A spacer device according to claim 1, wherein at least one of the said radially extending arms (3, 4, 5, 6) comprises attachment means whereby the arm can be attached to one of the metal bars forming the basket-shaped article to retain the spacer device in position.

4. A spacer device according to claim 3, wherein the attachment means comprises a hook (8) which hooks over one of the metal bars forming the basket-shaped article.

5. A spacer device according to claim 1, wherein each of the said arms extends radially outwardly from a central hub.

6. A spacer device according to claims 1, wherein each of the said arms extends radially inwardly from an annular support or collar the internal diameter of which is greater than the maximum outer diameter of the basket-shaped article.

7. A spacer device according to claim 6, wherein each of the said arms is at least partially retractable relative to the collar thereby facilitating placement of the spacer device over the unshaped metal bars and engagement of the arms in the gaps between adjacent pairs thereof, and of the spacer device from the finished basket-shaped article.

8. A spacer device according to claim 7, wherein the retractable arms are moved in and out of their working positions simultaneously by means of an automatic drive system.

9. A spacer device according to claim 7, wherein each of the arms is moved manually between its extended and retracted positions.

10. A spacer device according to claim 9, wherein each arm is connected to a spring which biases it towards its extended position and locking means for engaging the arm against the spring bias in its retracted position.

* * * * *